United States Patent [19]

Gatny

[11] 4,426,872

[45] Jan. 24, 1984

[54] DIE SET AND BILLET FOR USE THEREIN

[75] Inventor: David A. Gatny, Warren, Mich.

[73] Assignee: W-F Industries, Inc., Center Line, Mich.

[21] Appl. No.: 307,156

[22] Filed: Sep. 30, 1981

[51] Int. Cl.[3] ..... B21J 13/02

[52] U.S. Cl. ..... 72/359; 72/377

[58] Field of Search ..... 72/358, 359, 377

[56] References Cited

U.S. PATENT DOCUMENTS 4,222,260 9/1980 McDermott ..... 72/364

FOREIGN PATENT DOCUMENTS 564070 7/1977 U.S.S.R. ..... 72/377

*Primary Examiner*—Lowell A. Larson

*Attorney, Agent, or Firm*—Browdy and Neimark

[57] ABSTRACT

Method and apparatus for making certain types of parts which are stepped in one plane and curved in other planes transverse to the planes in which they are stepped. The invention uses a specially shaped billet which is formed into the part in a closed flashless die set at warm forging temperatures.

9 Claims, 14 Drawing Figures

DIE SET AND BILLET FOR USE THEREIN

This invention relates to warm forming or warm forging of metal parts. More in particular, the invention pertains to method and apparatus for making certain types of parts using warm forming techniques. Still more in particular, the invention pertains to methods and apparatus for making parts which are stepped in one plane and curved in another plane transverse to the plane in which they are stepped. The invention method includes the use of a billet which is configured in a particular manner in order to equal the weight of the part and in order to tightly fill the female cavity. The billet is provided with tapered ends in order to allow it to fit all the other constraints of the invention and to easily and quickly fall into the female cavity, as is required in high speed manufacturing methods. The ratios between the dimensions of the billet, both among themselves and with respect to similar dimensions in the part and in the die are critically controlled in accordance with the teaching of the invention, in order to produce such parts using the warm forming technique.

The invention's use of a warm forming technique is to be contrasted with the much more common hot forging techniques of the prior art. Hot forging normally requires the use of progressive dies, followed by machining of virtually all of the surfaces of the part in order to produce a finish acceptable in the end use of the part. Hot forging thus has many disadvantages, including the great expense of progressive dies, the waste material generated, and the additional expense and opportunities for human error in the finish machining required. In addition, hot forgings always have scale, which scale must be removed by sand blasting or tumbling or some other further procedure, thus generating further opportunity for loss and damage in addition to extra expense. Finally, hot forged parts simply cannot be made to the dimensional accuracy of parts made using warm forming techniques, as in the invention. Further, the special configuration of parts to which the invention is directed has not heretofore been able to be made by warm forming techniques.

In addition, the hot forging technique does not lend itself to producing good definition or detail in the parts produced. The main reason for this is that the scale, which is always present at hot forging temperatures when working with ferrous metals, has a tendency to "build up" in and around the dies, which causes these problems, and which can also disrupt production.

Thus, the invention's use of warm forging as opposed to hot forging temperatures provides the advantages of reducing or even substantially totally eliminating this harmful scale or oxide growth on the parts, as well as enabling parts to be produced to a high dimensional accuracy, to fine detail, and to the particular class of configurations to which the invention is specifically directed.

The invention, overall, teaches a method and apparatus for producing a warm formed part having all of the advantages over the prior art in a closed die, without a flash, by a single hit of the press, to produce parts of the configurational character described, all in a manner unknown heretofore. In hot forging and in other similar metal forming techniques, a flash is often formed, extra metal around the edges of the part in the die, which extra material must be removed to produce an adequate part. The present invention, by its use of a closed die, avoids this problem, and produces a flashless part.

The invention billet for manufacturing parts of the configurational character described, is axi-symmetrical. This often means that it is of a generally cylindrical character which is important in high volume production techniques as are currently frequently used, because the billets are delivered at high speed by automated equipment to the die cavity. By having the billet axi-symmetrical, it is possible to produce important additional advantages for the invention, as by using automated equipment to deliver high volumes of parts, accurately, since no positioning or complicated billet delivery systems are required. That is, the billets "want" to fall into the female die cavity in a proper orientation, which advantages are achieved by having the billets axi-symmetrical and using well proven material handling techniques and equipment. This advantage was not heretofore available to manufacture parts of the configurational character made by the invention.

Another advantage of the invention is that it is not restricted to the use of any particular type of die. Solid dies, segmented dies, one piece dies, and any other type available can be used in accordance with the teachings of the invention to achieve all of it's advantages. The choice of die, as is well known to those skilled in the art, will depend upon the particular part to be produced, as well as the material and specific temperatures employed.

Another element of the invention, more in detail, is the closed flashless die. This sort of die, as is known, depends upons the use of a billet which has an accurately measured volume and weight. The shape of the billet, therefore has to be carefully controlled. However, in the present invention, that is a highly important criterion, and the shape and dimensions must be determined accurately with respect to all of the other considerations to achieve those advantages set forth above, while producing parts of the configuration discussed. Thus, another element of the invention are the details of the preforming steps that go into the billet and it's particular configuration.

Another element of the invention is the use of an ejector which rapidly and accurately ejects finished parts from the female die after completion, and at the same time constitutes part of the die cavity when in it's retracted position. Thus, the invention teaches a preformed billet with tapered ends to permit it to contain sufficient weight and volume of material to produce the part, while at the same time permitting it to positively and accurately enter and locate in the die cavity in all directions. There is no problem with axial orientation, as set forth above, since the billet is axi-symmetrical. On the other hand, the specially configured billet of the invention requires slightly more effort for its preparation than the conventional shearing and sawing methods used in the prior art. The relatively minor additional amount of expense and effort that goes into the billet is more than offset by the advantages of producing a substantially finished part, having good detail, excellent surface quality, in fact surface qualities acceptable for final parts in many applications, and requiring, in many cases, virtually no further finishing techniques, and certainly none to remove scale or flash.

The above and other advantages of the invention will be pointed out or will become evident in the following detailed description and claims, and in the accompanying drawings also forming a part of the disclosure, in which:

Figure 3:
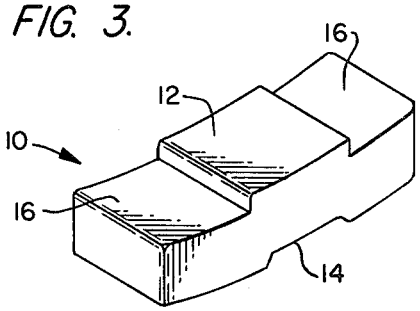
FIG. 3 is a perspective view of a part made from the billet and die shown in FIGS. 1 and 2.
Figure 5:
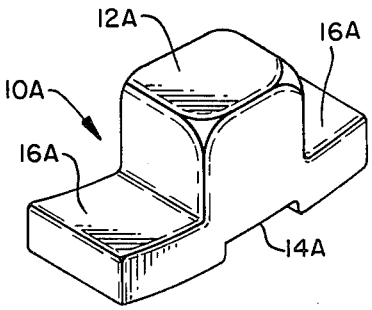
FIG. 5 is a view similar to FIG. 3 showing a similar part which can be made by other dies in accordance with the teachings of the invention.

Referring now in detail to the drawings, in FIG. 3 there is shown a part 10 which is of the type which can be advantageously manufactured in accordance with the teachings of the invention. A similar part **10*a* is shown in FIG. 5. Portions of the two parts 10 and 10*a*** which are similar will be designated by the same reference numeral followed by "a."

Figure 4:
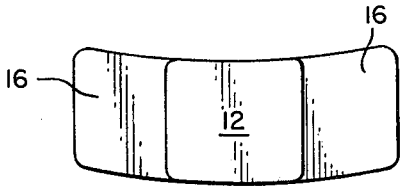
FIG. 4 is a top plan view of the part of FIG. 3.

Part 10 comprises a center stepped portion which comprises a top or "hat" portion 12 which is defined by a lower recessed portion 14. Referring again momentarily to FIG. 5, the major difference between the parts 10 and **10*a* can be seen as the size of this "hat" 12 as compared to the hat 12*a* of the FIG. 5 part. The part 10 comprises a pair of side portions 16 which extend out to both sides of the center thereof. Referring to FIG. 4, it can be seen how the part 10 is curved in a plane transverse to planes in which it is stepped. The part 10*a*** has a similar curvature, although this is not shown in the drawings.

Figure 1:
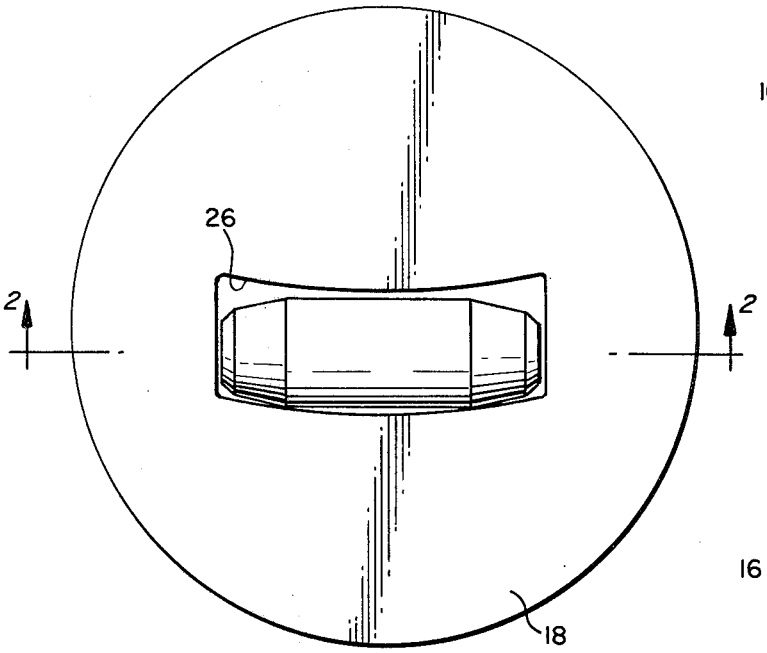
FIG. 1 is a plan view of a billet in a die in accordance with the invention.
Figure 2:
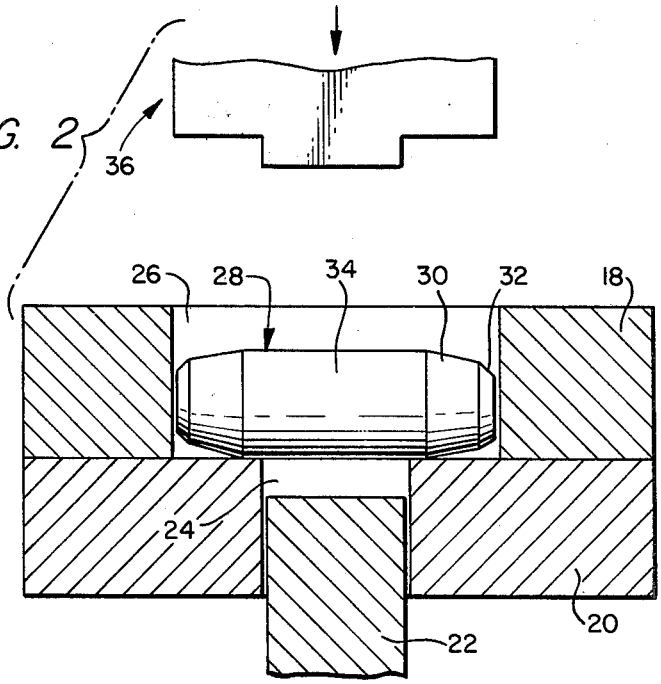
FIG. 2 is cross-sectional view taken on line 2—2 of FIG. 1.

Referring now to FIGS. 1 and 2, the invention is shown applied for use together with a die comprising a top female die 8, a bottom die 20, and an ejector 22. The equipment also includes a male punch 36 shown in FIG. 2, which includes means to define the bottom surface of the part 10 including the recess 14. The die cavity itself is defined in the parts 18, 20 and 22, with the space 24 above the ejector in the bottom die 20 being that portion which defines the "hat" 12. The die cavity 26 in the female die 18 defines all surfaces of the part save the hat 12 and the bottom surface including recess 14. The top surface of the ejector pin 22 defines the top surface of the hat 12, and the space 24 above the ejector, as shown in FIG. 2, defines the configuration of hat 12. All remaining surfaces of part 10, save the hat as defined above and save the bottom surface including the recess 14 which is defined by the male punch are defined by the recess 26 into the female die, as shown best in FIG. 1. This feature can also be appreciated by comparing the die cavity 26 in FIG. 1 with the plan view of the part in FIG. 4.

While the drawing shows a two part die, with each of the parts being in one piece, the invention is not so limited, and other types and configurations of die can also be used, as will be clear to those skilled in these arts.

Figure 6:
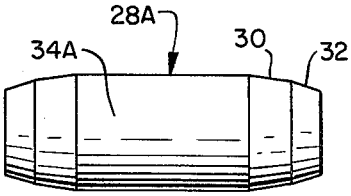
FIG. 6 is a showing of another billet useful in the invention.

The invention includes the use of a specially configured billet 28. Billet 28 is axi-symmetrical and of generally cylindrical configuration, as can be clearly seen by comparing FIGS. 1 and 2. Further, it is symmetrical about a central transverse plane, that is the two ends are similar to each other. Billet 28 comprises an end conical section 30, and a chamfer 32 at its outer tip. The main body portion 34 has two similar end portions, and the surfaces 30, 32 also appear at the other end. The billet overall is produced by a substantial amount of preengineering and predesign, such work being based upon the following formulas and mathematical analysis, and being, of course, primarily dictated by the particular configuration of a part 10 or **10*a* which is to be produced. The particular billet 28 shown in the drawings has been so engineered and configured to make the particular part 10, not the part 10*a*. The billet for the part 10*a* is considerably thicker in its central portion 34, and the other parts thereof are in proportion. The billet 28*a* for making the part 10*a* is shown in FIG. 6. The chamfered ends 32 are shown somewhat exaggerated in the drawings. These chamfers are not a major consideration in the design and configuration of this particular billet 28**, it is simply provided as a finishing aspect of the fabrication of the billets.

While the billets shown in the drawings are all of a generally cylindrical configuration, it is to be understood that the invention is not limited to a circular billet cross-sectional shape. What is important is that the billet be axi-symmetrical. A billet having a square cross-sectional shape or hexagonal cross-sectional shape or an oval cross-sectional shape, or having any other shape that would fulfill the requirement of "axi-symmetrical" are included in the teaching of the invention. "Axi-symmetrical" as used herein means that the billet is symmetrical about at least one plane containing its axis. The billet 28 of FIG. 6, is shorter and fatter, is also of cylindrical configuration, and the two sections 30 and 32 are more equal in axial length to each other in order to facilitate the fabrication of the part **10*a* with its relatively large hat 12*a***.

Figure 7:
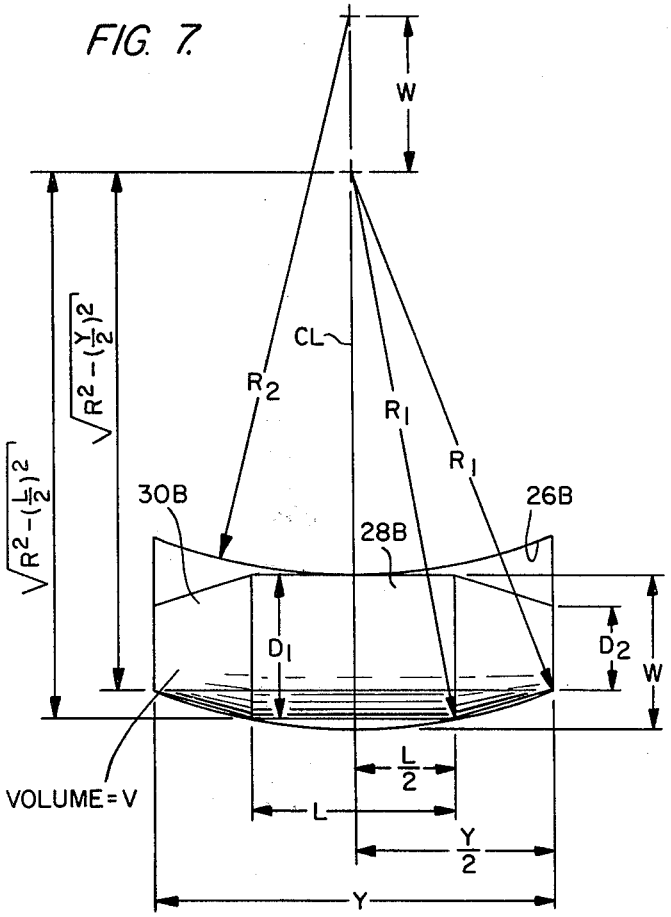
FIG. 7 is a drawing illustrating the mathematical principles underlying the invention.
Figure 8A:
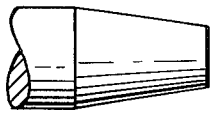
FIGS. 8A to 8E are a family of drawings showing other billet end configurations.
Figure 8B:
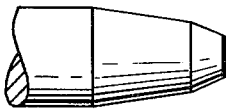
Figure 8C:
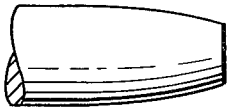
Figure 8D:
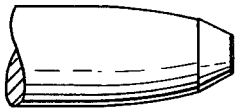
Figure 8E:
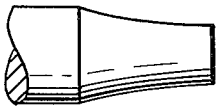

FIG. 7 shows an idealized arrangement of a billet 28 in a die cavity 26, the reference letter "B" being added to distinguish this showing from the first embodiment of FIGS. 1 thru 4. Before going into the theoretical analysis, it should be first understood that the criteria include that the weight of the billet must be substantially and almost exactly equal to the weight of the finished part. Further, it is desired to have the volume of the billet as large as possible with respect to the die cavity. The purpose of this volume relationship is that if the volumes are substantially equal, the possibility of the billet entering the female die cavity in any orientation other than the correct orientation is greatly diminished. Taking that thinking to its extreme, by way of further explanation, it is clear that a square peg can go into a square hole in only one relative position.

Given those constraints, billets formed by conventional shearing and sawing methods cannot be used, because the curved outer boundary of the female die precludes providing a billet that will have a volume equal to the volume of the finished part. By utilizing a billet in which both ends are reduced in diameter, sufficient material volume can be obtained to meet the first criterion while at the same time meeting the second criterion. Thus, it can be seen that the relationships of the dimensions of the die and of the billet, with respect to themselves and with respect to each other in various relationships as set forth below, are an element of this invention.

Further in that regard, referring to the family of drawings of FIGS. 8*a* thru 8*e*, a number of different end configurations are shown. All of these possibilities, and others are available in using the teaching of the invention.

Another facet of the axi-symmetrical requirement of the billet is that the axis of the billet cannot be coincident with the direction of the forging stroke. Otherwise, the billet could not fit into a curved die cavity, the curvature occurring in planes perpendicular to the direction of the forging stroke.

Referring now in detail to FIG. 7, the die cavity 26*b* is defined by the width dimension W, the length dimension Y, and the two radii $R_1$ and $R_2$. In actual practice, the radii $R_1$ and $R_2$ have been selected to be equal, and are simply displaced along the same center line by the distance W, the thickness of the die cavity. However, radius $R_2$ is less important, it can be significantly different from the radius $R_1$. If the part to be made had a curvature which was different on one side than on the other, then of course $R_1$ and $R_2$ would be different. $R_2$ could even be infinite, that is the top of the die cavity could be a straight line. $R_2$ is a relatively flexible variable therefore in making the volume of the die cavity equal to the volume of the finished part.

The dimension Y, the length, is shown as being equal for the billet as well as for the die cavity. This is for purposes of the theoretical discussion, of course, the billet must be slightly shorter than the die cavity in order to fit into the die cavity.

The billet 28*b* is made up of a minor smallest diameter $D_2$, a major diameter $D_1$ defining the main body part, and a length L of the main body defined by $D_1$. The half dimensions of L and Y are shown for the mathematical analysis and to indicate the fact that the billet is symmetrical left and right of the center line. The particular configuration of the section 30*b* between the diameters $D_1$ and $D_2$ need not necessarily by cylindrical, as is shown in the family of FIG. 8.

The billet dimension $D_1$ must always be less than the cavity dimension W, because otherwise L would be 0. The dimension $D_1$ together with the dimension L determines the "fit" of the billet into the die cavity.

Thus, one expression of the design problem which is solved by the invention is to determine what combination of $D_1$ less than W, and L, in the range of L more than O and less than Y together with the control of $D_2$, to permit the largest volume of billet equal to the volume of the part. If these relationships cannot be met, then it will be impossible to make that particular part in accordance with the teaching of the invention.

Continuing this design analysis and mathematical development, the dimensions W Y $R_1$ and $R_2$ are all fixed for the designer, as they are a direct function of the part to be made. There are four parameters of the billet, namely $D_1$ $D_2$ L and Y. Y is fixed since it has to be substantially equal to the same dimension Y of the die cavity. Thus, the approach in the analysis which follows is to express $D_1$ and $D_2$ in terms of the variable L and together with combinations of W, Y, and $R_1$ and $R_2$, so as to maximize the billet volume for the particular die cavity. In this way, the desired maximum volume can be expressed as a function of L and other parameters of the billet. Alternatively, the equations can be worked otherwise, and can be expressed in terms of $D_1$ and $D_2$, and that could also be usable dependant upon the particular constraints and desired end results of a particular part.

Referring to the drawing, for any given L, the maximum value of $D_1$ is given by the following expression:

$$D_1 = W - \left(R - \sqrt{R^2 - \frac{L^2}{4}}\right) \tag{1}$$

For the same length L, the maximum of $D_2$ is expressed by either one of the following two equations:

$$D_2 = W - \left(R - \sqrt{R^2 - \frac{L^2}{4}}\right) - 2\left(\sqrt{R^2 - \frac{L^2}{4}} - \sqrt{R^2 - \frac{Y^2}{4}}\right) \tag{2A}$$

OR $$D_2 = W - R + 2\left(\sqrt{R^2 - \frac{Y^2}{4}}\right) - \sqrt{R^2 - \frac{L^2}{4}} \tag{2B}$$

By using these two equations, the volume of the billet can be calculated as follows:

$$\text{Volume} = D_1^2 \frac{\pi}{4} L + .2618\,(D_1^2 + D_1 D_2 + D_2^2)\,(Y - L)$$

By differentiating the billet volume with respect to L, and equating the differentiated result to zero, the maximum volume for the given value of R, W, and Y may be found. Equation (4) expresses this relationship:

$$\frac{d\,\text{Volume}}{dL} = 0 = \frac{\pi L^2}{8}\left[\frac{(R - W)}{\sqrt{R^2 - \frac{L^2}{4}}} - 1\right] + \frac{\pi}{2}\left[\frac{W^2 - 2WR + 2R^2}{2} + (W - R)\sqrt{R^2 - \frac{L^2}{4}} - \frac{L^2}{8}\right] + \frac{(Y - L)\pi}{12}\left[\frac{(R - W)L}{2\sqrt{R^2 - \frac{L^2}{4}}} + \frac{\left(W - R + \sqrt{R^2 - \frac{Y^2}{4}}\right) L}{2\sqrt{R^2 - \frac{L^2}{4}}} - \frac{L}{2}\right] - \frac{\pi}{12}\left[3W^2 - 6WR + 8R^2 + \left(6W - 6R - 2\sqrt{R^2 - \frac{L^2}{4}}\right)\sqrt{R^2 - \frac{Y^2}{4}} - \frac{L^2}{4} - Y^2\right] \tag{4}$$

These equations were used in the design work resulting in the successful constructed embodiment. By way of example, where R=4.96; W=0.79; and Y=2.13; the maximum billet volume occurs at approximately L=1.20. All of the above numbers are expressed in the same units.

Certain other ratios and relationships of parameters can also be determined for any particular part. For the lug 10 shown in FIG. 3 the following ratios have been found to be valid:

$$\frac{L}{Y} < .71 \quad \frac{D_2}{D_1} > .27$$

For the very similar lug 10*a* shown in FIG. 5, the following ratios have been found to be valid $$\frac{L}{Y} < .73 \quad \frac{D_2}{D_1} > .26$$

More graphically, the designer can be aided by plotting the billet volume as a function of length, and this result is shown in FIG. 9, again the units are all consistent.

Figure 9:
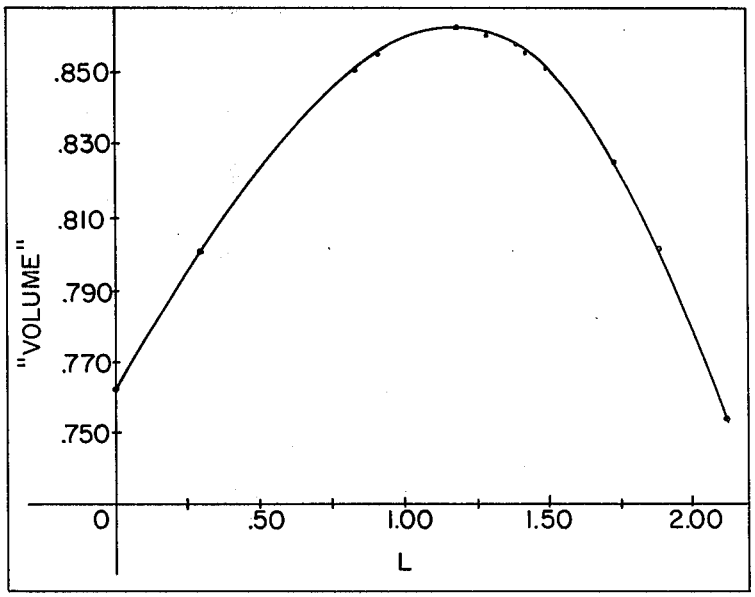
FIG. 9 is a curve showing billet volume as a function of its length.

The curve of FIG. 9 clearly shows that, for this particular set of values, L=1.2 is a maximum. In other situations where the extra effort to graph results is not done, one can take the second derivitive of equation 4, and that, of course, will indicate whether the particular point is a maximum or minimum.

Figure 10:
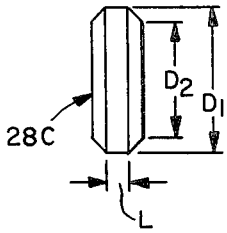
FIG. 10 shows another type of billet of the invention.

Referring to FIG. 10, another billet 28*c* is shown. This billet, although it differs substantially in overall appearance from the billets shown heretofore, also fits the constraints of the invention. In this case, $D_1$ and $D_2$ are very much larger than L, however such a billet is deemed usable with the invention for making an appropriately shaped part. The center line of this billet, called for the sake of convenience herein "the button", is also perpendicular to the direction of the forging stroke of the punch 36.

In regard to the warm forming temperature, depending upon the part, the particular metal alloy, and the like, any temperature in the normal warm forging range of approximately 1500° F. to 2000° F. can be used. A range of 1800° F. to 1850° F. at the time of the forging stroke is preferred for many alloys and the parts which have been made in accordance with the invention, such as the part 10 of FIG. 3.

The parts 10 and 10*a* shown in FIGS. 3 and 5 are known as lugs and are used in the automatic transmissions of certain vehicles. However, of course, the mention is not so limited and can be used in manufacturing any similar parts in accordance with the criteria of the invention, as set forth above, and in the following claims.

While the invention has been described in detail above, it is to be understood that this detailed description is by way of example only, and the protection granted is to be limited only within the spirit of the invention and the scope of the following claims.

I claim:

1. A method of making a curved part comprising the steps of preparing a billet of axi-symmetrical configuration, preforming said billet so that its volume is substantially equal to the volume of said part, pre-forming said billet with an overall length Y and a central portion of length L both measured along its axis and a dimension $D_1$ transverse to its axis through its length L, pre-forming said billet with dimension $D_2$ transverse to its axis at each end thereof, said dimension $D_2$ being smaller than said dimension $D_1$, pre-forming said billet with end portions transitioning between the dimension $D_1$ at the ends of the length L to the dimensions $D_2$ at the ends of the overall length Y, preparing female die means for forming said curved part in a die cavity formed in said female die means, dimensioning said die cavity with an overall length Y substantially equal to the overall length Y of said billet but slightly larger to permit entry of said billet into said die cavity, said part and said die cavity being curved in a plane containing the axis of said billet when said billet is in said die cavity, said die cavity being further defined by a width W and curved surfaces defined by radii $R_1$ and $R_2$, said billet dimension $D_1$ being less than said cavity dimension W, said billet dimension L being in the range of greater than zero and less than dimension Y, inserting said billet into said die cavity with its axis substantially perpendicular to the axis of the forging stroke of punch means into said cavity, heating said billet to a warm forming temperature, using punch means to form said heated billet in said cavity into said part with a single stroke of said punch into said cavity to produce said part as a flashless part, said plane in which said part and said die are curved and the plane containing said radii $R_1$ and $R_2$ both being located substantially at right angles to the line defined by the stroke of said punch into said cavity.

2. The method of claim 1, providing an ejector means in said female die means, positioning said ejector means away from billet in said cavity, said ejector means comprising a part of said die cavity to define said part; whereby said part is stepped in planes perpendicular to the planes in which it is curved.

3. The method of claim 1, wherein the ratio of $D_2$ divided by $D_1$ is more than 0.27 and the ratio of L divided by Y is less than 0.71.

4. The method of claim 1, wherein the ratio of $D_2$ divided by $D_1$ is more than 0.26 and the ratio of L divided by Y is less than 0.73.

5. The method of claim 1, wherein the shape of a said end portion of said billet where it transitions from $D_1$ to $D_2$ has a configuration defined by a single truncated cone.

6. The method of claim 1, wherein the shape of a said end portion of said billet where it transitions from $D_1$ to $D_2$ has a configuration of a compound conical solid.

7. The method of claim 1, wherein the shape of a said end portion of said billet where it transitions from $D_1$ to $D_2$ has a configuration defined by an outside convex line which is part of a single spherical surface.

8. The method of claim 1, wherein the shape of a said end portion of said billet where it transitions from $D_1$ to $D_2$ has a configuration delineated by a convex compound surface at least a portion of which is defined by a line which is part of a spherical surface.

9. The method of claim 1, wherein the shape of a said end portion of said billet where it transitions from $D_1$ to $D_2$ has a configuration defined by a concave line which is part of a spherical surface.

* * * * *